US006824215B2

(12) United States Patent
Koepke et al.

(10) Patent No.: US 6,824,215 B2
(45) Date of Patent: Nov. 30, 2004

(54) ADJUSTMENT MECHANISM WITH TORQUE LIMITING AND ANTI-LOOSENING FEATURES

(75) Inventors: Marcus C. Koepke, Indianapolis, IN (US); Jay R. Machael, Muscatine, IA (US); Brian R. Trego, Muscatine, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/461,082

(22) Filed: Jun. 13, 2003

(65) Prior Publication Data

US 2003/0235464 A1 Dec. 25, 2003

Related U.S. Application Data

(63) Continuation-in-part of application No. 10/077,313, filed on Feb. 15, 2002, now Pat. No. 6,634,711, and a continuation-in-part of application No. 09/881,896, filed on Jun. 15, 2001, now Pat. No. 6,688,692.

(51) Int. Cl.[7] ..... A47C 1/023
(52) U.S. Cl. ..... 297/337; 297/344.11
(58) Field of Search ..... 297/337, 344.11

(56) References Cited

U.S. PATENT DOCUMENTS

| | | | | |
|---|---|---|---|---|
| 2,634,650 A | | 4/1953 | Coop | |
| 3,235,308 A | | 2/1966 | Conner | 297/337 |
| 3,982,785 A | | 9/1976 | Ambasz | 297/239 X |
| 5,035,466 A | | 7/1991 | Mathews et al. | 297/337 |
| 5,074,620 A | | 12/1991 | Jay et al. | 297/337 |
| 5,390,978 A | | 2/1995 | Janisch | 297/337 X |
| 5,556,163 A | | 9/1996 | Rogers, III et al. | 297/337 X |
| 5,575,534 A | | 11/1996 | Yu | 297/337 X |
| 5,577,807 A | | 11/1996 | Hodge et al. | |
| 5,607,204 A | | 3/1997 | Gryp | 297/337 X |
| 5,755,488 A | | 5/1998 | Beda et al. | 297/337 X |
| 5,755,490 A | | 5/1998 | Lamart | 297/337 X |
| 5,782,536 A | * | 7/1998 | Heidmann et al. | 297/337 X |
| 5,795,116 A | | 8/1998 | Frank et al. | |
| 5,871,258 A | | 2/1999 | Battey et al. | |
| 5,873,634 A | | 2/1999 | Heidmann et al. | 297/337 X |
| 5,904,459 A | | 5/1999 | Prathap et al. | |
| 5,909,923 A | | 6/1999 | DeKraker | |
| 5,975,634 A | | 11/1999 | Knoblock et al. | |
| 5,979,984 A | | 11/1999 | DeKraker et al. | |
| 6,027,129 A | | 2/2000 | Kleinschmit et al. | |
| 6,027,168 A | | 2/2000 | Crossman et al. | 297/337 |
| 6,070,774 A | | 6/2000 | Rak et al. | |
| 6,086,153 A | | 7/2000 | Heidmann et al. | |
| 6,099,076 A | | 8/2000 | Nagel et al. | 297/337 |
| 6,116,695 A | | 9/2000 | Heidmann et al. | |
| 6,135,556 A | | 10/2000 | Chu et al. | 297/337 |
| 6,179,384 B1 | | 1/2001 | DeKraker et al. | |
| 6,193,313 B1 | | 2/2001 | Jonsson | 297/337 X |
| 6,203,107 B1 | | 3/2001 | Jonsson | 297/337 |
| 6,402,245 B1 | | 6/2002 | Newton et al. | 297/337 X |
| 6,513,222 B2 | * | 2/2003 | Von Ehr et al. | 297/337 X |
| 6,634,711 B2 | * | 10/2003 | Phillips et al. | 297/337 |
| 6,688,692 B2 | * | 2/2004 | Phillips et al. | 297/337 |
| 2002/0190558 A1 | * | 12/2002 | Phillips et al. | 297/337 |
| 2002/0190559 A1 | * | 12/2002 | Phillips et al. | 297/337 |

OTHER PUBLICATIONS

Publication No. 2001/0050503–A1, G. Piretti, Dec. 13, 2001.

Publication No. 2002/0074841–A1, T. Chen, Jun. 20, 2002.

* cited by examiner

*Primary Examiner*—Rodney B. White
(74) *Attorney, Agent, or Firm*—Joseph H. Golant; Jones Day

(57) ABSTRACT

An adjustable chair seat with a locking mechanism that is torque limiting and resistant to loosening. The chair includes a seat pan, a seat plate, a rotatable fastener and two rings. The seat pan and seat plate have openings for receiving the fastener. The fastener includes a cup handle and a threaded insert. The threaded insert is engaged with the seat pan through an opening in the seat pan while the seat plate is sandwiched between the seat pan and the fastener. When being rotated, the cup handle slips relative to the threaded insert after a predetermined resistance is reached so as to cease the application of torque to the threaded insert. One of the rings is keyed to rotate with the fastener and the other ring is keyed to remain non-rotatable. The first ring includes an array of cantilevered teeth where each tooth has a first surface disposed at a smaller angle from a horizontal reference plane and a second surface which is disposed at a greater angle from the horizontal reference plane. This arrangement results in the requirement of a lesser torque to tighten the fastener than to loosen the fastener.

18 Claims, 7 Drawing Sheets

ADJUSTMENT MECHANISM WITH TORQUE LIMITING AND ANTI-LOOSENING FEATURES

CROSS REFERENCE TO RELATED APPLICATIONS

The present application is a continuation-in-part of Application No. 10/077,313, filed on Feb. 15, 2002, now U.S. Pat. No. 6,634,711, entitled "Adjustable Chair Seat With Locking Mechanism", and a continuation-in-part of Application No. 09/881,896, filed on Jun. 15, 2001, now U.S. Pat. No. 6,688,692, entitled "Locking Device For Chair Seat Horizontal Adjustment Mechanism", and is related to co-pending Application No. 10/077,409, entitled "Improved Ergonomic Chair", filed on Feb. 15, 2002, all commonly assigned, the disclosures of which are all incorporated herein by reference.

BACKGROUND OF THE INVENTION

Statement Regarding Federally Sponsored Research

Not applicable.

1. Field of the Invention

The present invention relates to an adjustment mechanism and more particularly to an adjustment mechanism suitable for adjusting an office chair seat where the adjustment mechanism includes torque limiting and anti-loosening features and is inexpensive and simply constructed.

2. Description of the Related Art

Adjustable chairs are known in the art as exemplified by office type chairs disclosed in U.S. Pat. Nos. 5,755,488, 5,765,804 and 5,971,484. Nevertheless, such chairs are expensive, overly complicated and at times unreliable. Often such chairs have adjustable seats and/or backs using friction engagement to retain an adjusted position. These mechanisms, however, tend to be unreliable, expensive or difficult to manipulate or all three.

BRIEF SUMMARY OF THE INVENTION

The difficulties encountered by the previous devices have been overcome by the present invention. What is described here is an adjustment mechanism for locking and unlocking two relatively movable parts, the mechanism comprising a fastener with a key element, a first structure having a key element complementary to the key element of the fastener and a second structure having a key adapted to engage a complementary key element of one of the two relatively movable parts to prevent the second structure from moving, the first and the second structures including elements for allowing relative movement of the first and second structures in a first direction at a first torque level and in a second direction at a second higher torque level.

There are a number of advantages, features and objects achieved with the present invention which are believed not to be available in earlier related devices. For example, one advantage is that the present invention provides a horizontally adjustable chair seat which is simply constructed and easily manipulated. Another object of the present invention is to provide an adjustable chair seat which is reliable. A further feature of the present invention is to provide a chair seat adjustment mechanism that is easily formed and simple to assemble.

A more complete understanding of the present invention and other objects, advantages and features thereof will be gained from a consideration of the following description of preferred embodiments read in conjunction with the accompanying drawing provided herein. The preferred embodiments represent examples of the invention which are described here in compliance with Title 35 U.S.C. section 112 (first paragraph), but the invention itself is defined by the attached claims.

DETAILED DESCRIPTION OF PREFERRED EMBODIMENTS OF THE INVENTION

Figure 1:
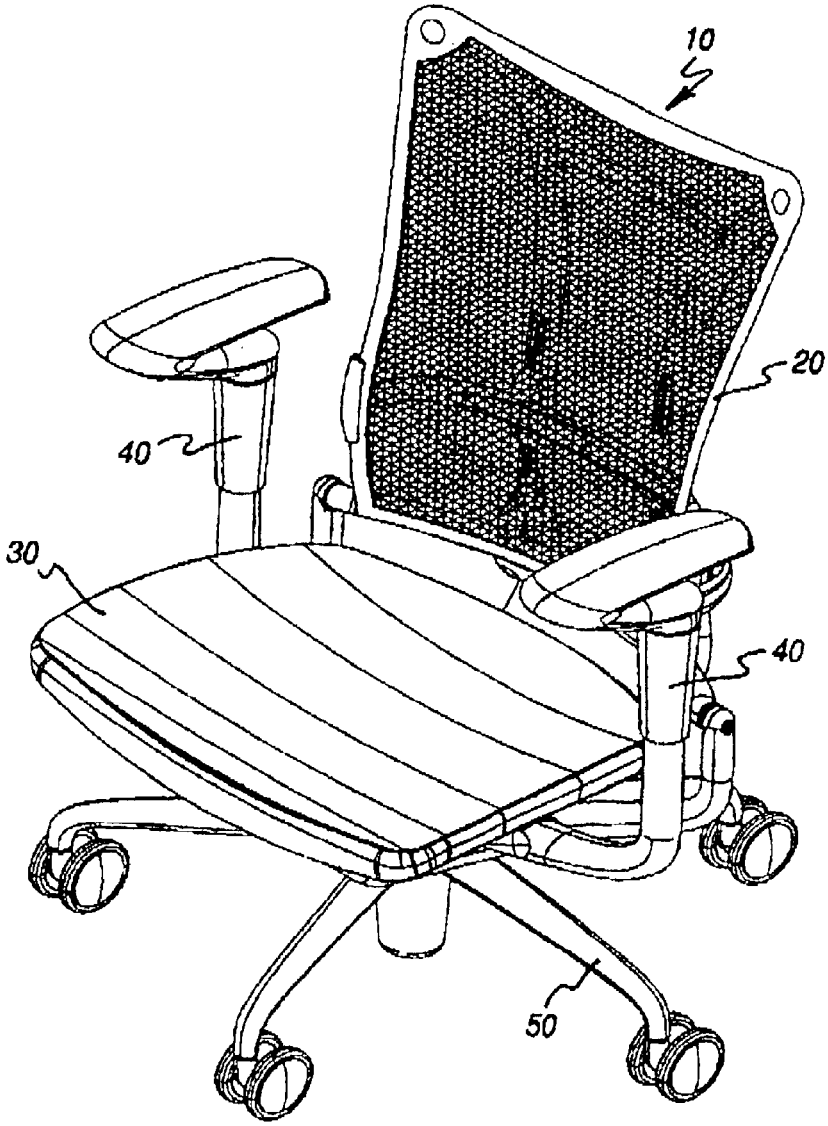
FIG. 1 is a front isometric view of an office chair.

While the present invention is open to various modifications and alternative constructions, the preferred embodiments shown in the various views of the drawing will be described herein in detail. It is understood, however, that there is no intention to limit the invention to the particular forms or examples disclosed herein. On the contrary, the intention is to cover all modifications, equivalent structures and methods, and alternative constructions falling within the spirit and scope of the invention as expressed in the appended claims, pursuant to Title 35 U.S.C. § 112 ($2^{nd}$ paragraph).

Referring first to FIG. 1, there is illustrated an office chair 10 having a backrest assembly 20, a seat assembly 30, two armrest assemblies 40 and a pedestal 50. The detailed disclosure here concentrates on the seat assembly 30. As will be explained below, the seat is horizontally adjustable, easy to manipulate, simply constructed, easy to form and assemble and very reliable.

Figure 2:
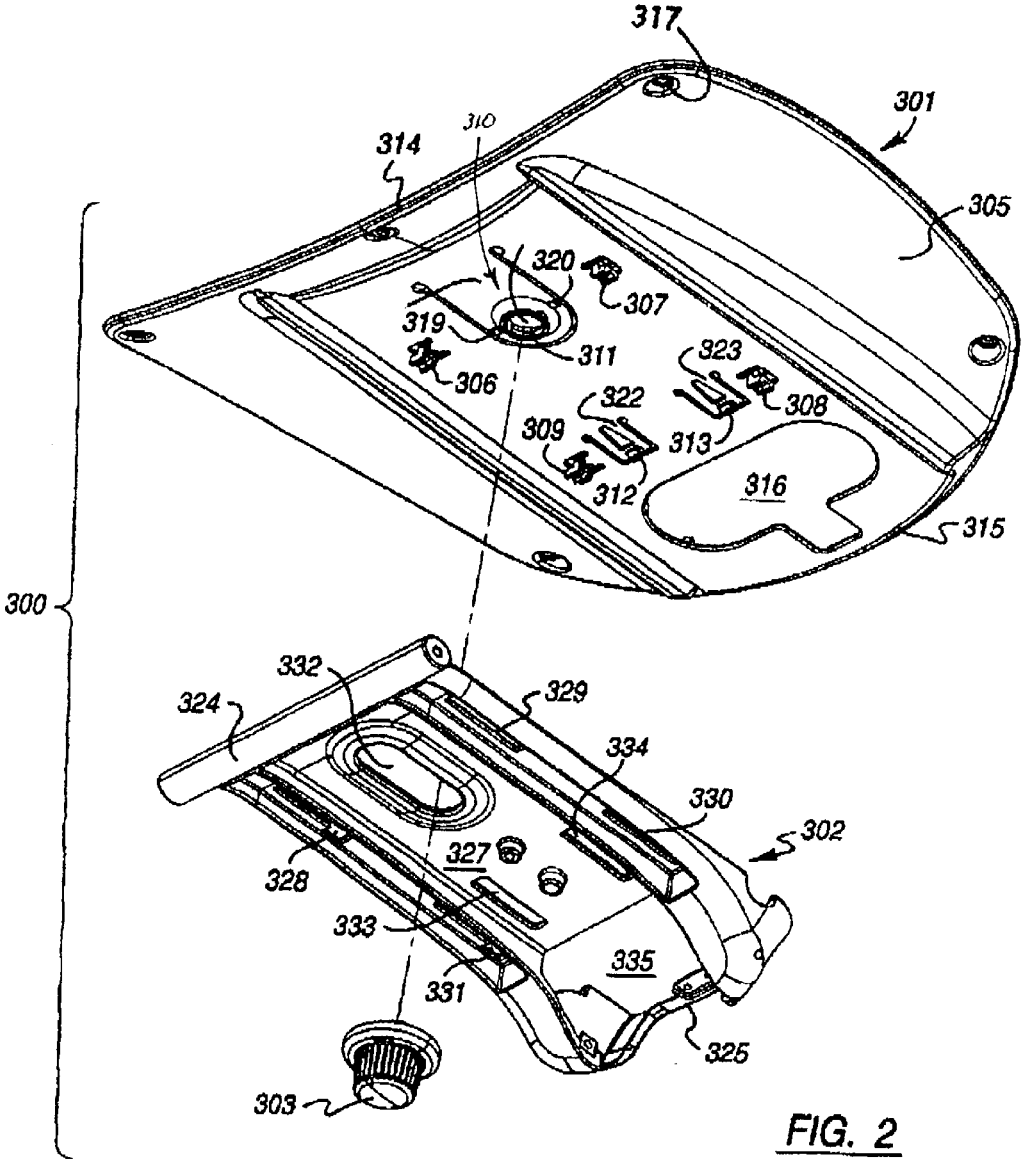
FIG. 2 is a right front upward looking exploded isometric view of a seat pan, a seat plate and a fastener used in the chair shown in FIG. 1.
Figure 3:
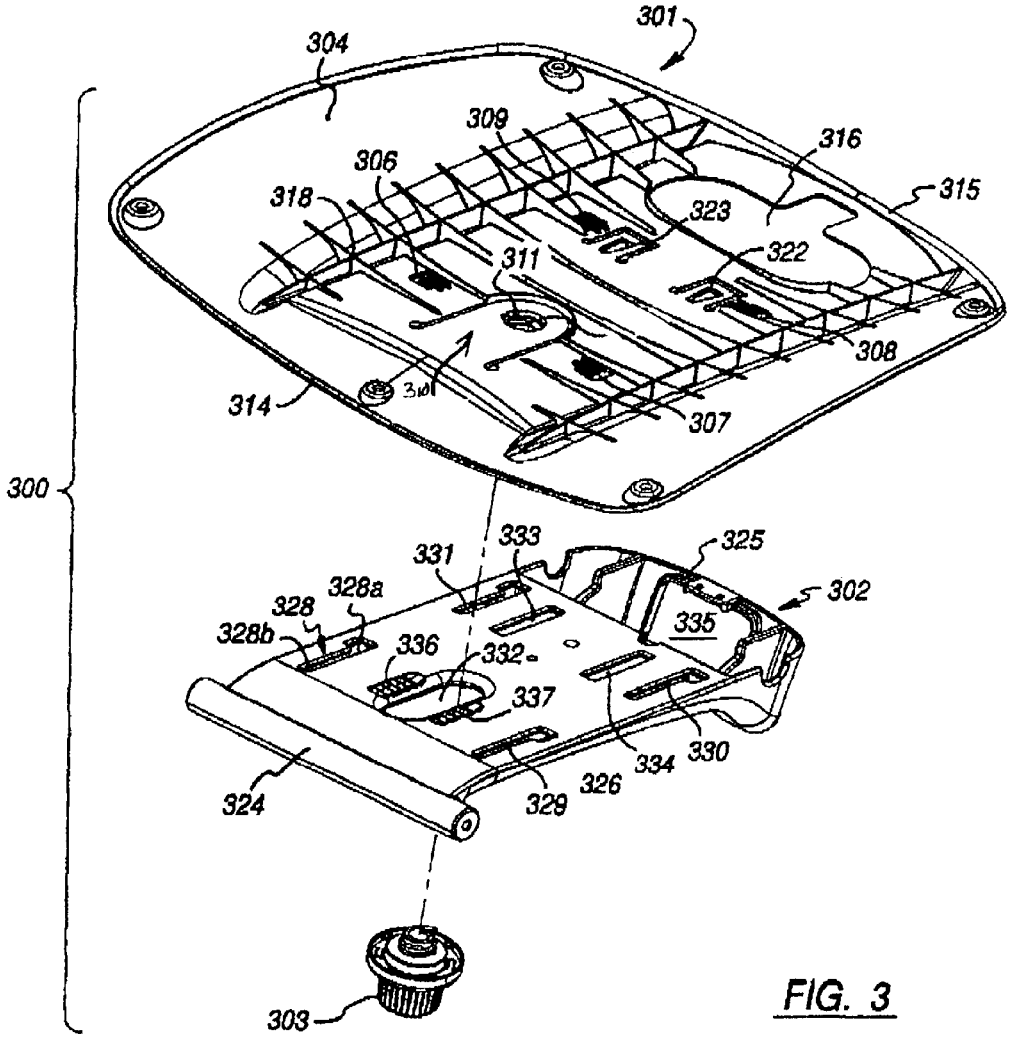
FIG. 3 is a right front downward looking exploded isometric view of the seat pan, the seat plate and the fastener.

Referring now to FIGS. 2 and 3, a partial seat assembly and adjustable locking mechanism 300 is illustrated in detail where FIG. 2 is a front upward looking exploded isometric view and FIG. 3 is a front downward looking exploded isometric view. The partial seat assembly and adjustable lock mechanism includes a seat pan 301, a seat plate 302 and a fastener 303.

The seat pan may be made of any suitable material such as a synthetic resin and may be molded as an integral piece. The seat pan includes an upper portion 304 and a lower portion 305. The upper portion is covered with a cushion shown in FIG. 1 and forms the seating surface of the chair 10. The seat pan also includes four spaced-apart depending L-shaped engagement fingers, 306, 307, 308, 309 formed in the lower portion, a fastener receiving element 310 in the form of a beam having an opening formed by a rim 311, and two depending abutment elements 312, 313. The abutment elements are to limit horizontal travel of the seat pan in relation to the seat plate to prevent separation of the pan and the plate once they are assembled. The seat pan also includes a front portion 314 and a rear portion 315.

A large opening 316 is located in the rear portion of the seat pan. Peripheral fastener openings, such as the opening 317 are provided to fasten the seat cushion to the seat pan. The seat pan further includes a series of strengthening ribs, such as the rib 318 in the upper portion. Flanking the beam opening rim 311 are two depending bumps 319, 320. The beam opening rim 311 and the two bumps 319, 320 are formed on the fastener receiving element. Because the material of the seat pan is a synthetic resin, the fastener receiving element beam is resilient and thus able to flex in response to any applied force. Such a force may come from contact between the seat plate 302 and the bumps 319, 320 on the seat pan during seat adjustment. The abutment elements 312, 313 are also formed at the end of respective beam structures 322, 323 to provide flexibility during assembly as will be explained below.

Continuing to refer to FIGS. 2 and 3, the seat plate may be formed of any suitable strong material, such as aluminum. As with the synthetic resin seat pan, the seat plate may be formed as an integral piece. The seat plate includes a front portion 324, a rear portion 325, a top portion 326 and a bottom portion 327. The seat plate includes four guide slots 328, 329, 330, 331, each with an enlarged head opening, such as the head opening 328*a*, and a narrow body opening, such as the body opening 328*b*. The guide slots cooperate with the L-shaped engagement fingers 306, 307, 308, 309 of the seat pan for restraining and guiding the seat pan in forward and rearward movements in a generally horizontal direction relative to the horizontally fixed seat plate.

The seat plate also includes an elongated fastener receiving opening 332 and two motion limiting slots 333, 334. The slots limit the horizontal movement of the seat pan by limiting movement of the abutment elements 312, 313 in their respective slots. At the rear portion of the seat plate is a large opening 335. To either side of the elongated fastener receiving opening 332 is a set of recesses 336, 337 in the top portion 326. As will be explained below, each set of recesses forms a detent with a corresponding bump on the lower portion of the seat pan. Because the bumps are part of the cantilevered fastener receiving element 310, the bumps are cammed when moved from one pair of recesses to another as the seat pan is adjusted relative to the seat plate.

The motion limiting slots 333, 334 receive the abutment elements 312, 313, respectively, and limit movement of the seat pan so that the L-shaped fingers do not disengage from the guide slots after assembly has taken place. Because the abutment elements are formed on the cantilevered beams 322, 323, the abutment elements are cammed when the seat pan is pressed against the seat plate at the time the L-shaped fingers are first inserted into the guide slots. When the L-shaped fingers move away from their respective enlarged head openings, the abutment elements are able to snap into the motion limiting slots 333, 334. The interference fit between the abutment elements and the walls around the motion limiting slots prevent the L-shaped fingers from returning to the enlarged head openings and disengaging from the guide slots. As can be appreciated the seat pan and seat plate may be easily constructed and assembled.

Figure 4:
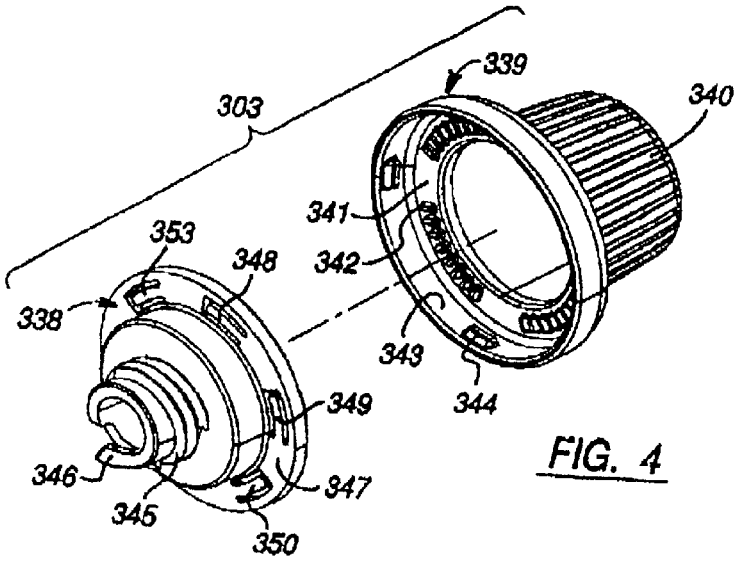
FIG. 4 is an exploded isometric view of the fastener illustrating its parts, a threaded insert and a cup handle.
Figure 5:
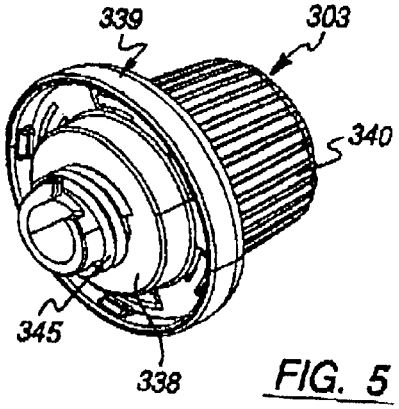
FIG. 5 is an isometric view similar to the view of FIG. 4 but with the parts of the fastener being assembled.
Figure 6:
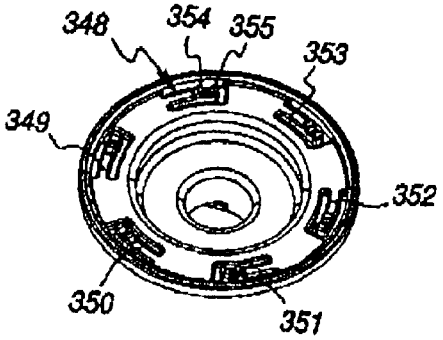
FIG. 6 is a rear isometric view of the threaded insert.

The simplicity of the disclosed seat assembly and adjustable lock mechanism may be appreciated further by referring now to FIGS. 4, 5 and 6, where the fastener 303 is shown in more detail. The fastener 303 is torque limiting and includes two parts, a threaded insert 338 and a cup handle 339. The cup handle includes an outer surface 340 having a series of grooves and ridges to facilitate gripping by a user and to facilitate rotational manipulation. The cup handle also includes an annular flange surface 341 having a plurality of projections, such as the projection 342. At generally right angles to the flange surface is a ring surface 343 having several snap retainers, such as the snap retainer 344. The threaded insert 338 includes a screw thread 345, an extending flexing tooth 346, an annular rim 347 and an annular array of resiliently mounted or cantilevered slanted teeth assemblies, such as the teeth assemblies 348, 349, 350, 351, 352, 353. By way of example, slanted teeth 354 and 355 may best be seen on the teeth assembly 348.

The threaded insert and the cup handle may each be molded of a synthetic resin as an integral piece. The threaded insert and the cup handle may also be easily assembled by inserting the annular rim 347 of the threaded insert into the ring surface 343 of the cup handle so as to pass the projecting snap retainers 344. As the annular rim passes the snap retainers, the ring surface is cammed or distorted outwardly. When the annular rim completes the passage, the ring surface snaps back and creates an interference fit between the snap retainers and the annular rim. Once the cup handle and the threaded insert are connected, the threaded insert may be rotated by the cup handle.

During assembly the fastener passes through the elongated fastener receiving opening 332 in the seat plate 302 and makes engagement with the rim 311 of the fastener receiving element 310 in the seat pan 301. Once engagement is made between the threaded insert and the rim 311, the flexing tooth 346 of the threaded insert will deform and pass through the opening of the fastener receiving element 310. In this manner the fastener is retained by the seat pan even when the fastener 303 is rotated in an opposite direction in an attempt to disengage from the seat pan.

When the fastener is rotated in a clockwise direction, it will tighten the engagement of the seat pan and the seat plate to create a frictional and mechanical interference to any horizontal movement between these two parts. Thus, a locking engagement is created. Moreover, after a predetermined torque is reached, further tightening rotation of the cup handle will cause the arrays of resiliently mounted and slanted teeth assemblies to slip relative to the plurality of projections 342 such that the cup handle will rotate freely relative to the threaded insert and no further torque will be applied to the threaded insert.

In operation, the seat pan, the seat plate and the fastener are all formed using well known techniques. Assembly is simple and easy. The seat pan and the seat plate are aligned to allow the L-shaped fingers to pass through the enlarged openings at the end of the guide slots and then for the abutment elements to be placed into the motion limiting slots. Thereafter, the threaded insert and the cup handle are pressed together to form a single fastener unit and then the fastener is threaded into the fastener receiving opening of the seat pan with the seat plate sandwiched between them. Once the seat pan and the fastener are engaged, they will not separate; however, the fastener may be loosened or tightened simply by rotating the cup handle clockwise or counterclockwise. When the fastener is loosened, the seat pan may be adjusted generally horizontally relative to the seat plate for the chair user's comfort. Because of the bumps and recesses, a detent is formed which is easily heard and felt by the chair user to help in the adjustment process. When the adjustment is complete, the fastener is counter rotated to squeeze the seat pan and the seat plate together. The fastener may be tightened without fear of damage to the fastener, the seat plate or the seat pan because when a predetermined resistance is reached, the cup handle will "slip" relative to the threaded insert as the cantilevered slanted teeth slide over the plurality of projections.

Figure 7:
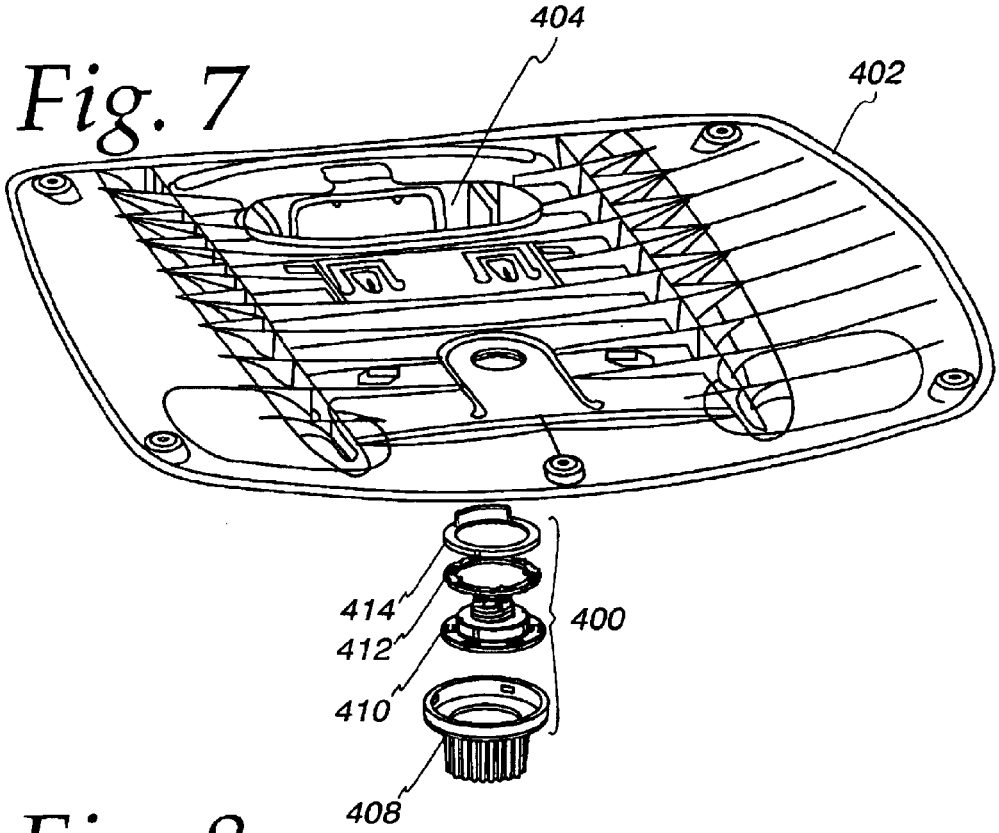
FIG. 7 is a downward looking isometric view of the seat pan and the seat plate as well as the fastener and two rings that prevent inadvertent loosening of the fastener.
Figure 8:
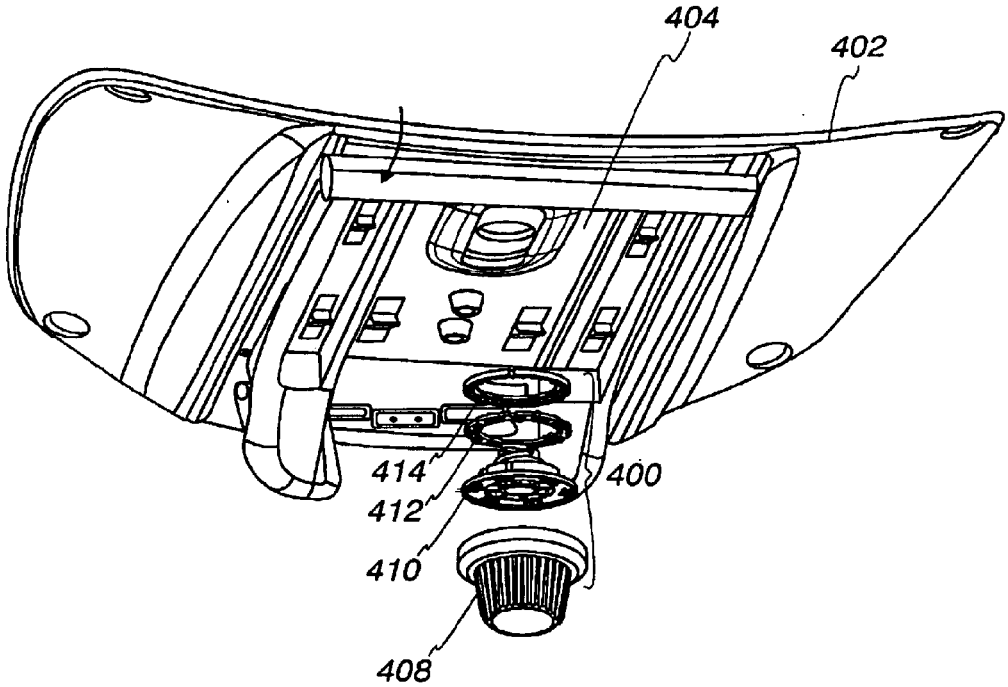
FIG. 8 is an upward looking, partially exploded isometric view of the same elements shown in FIG. 7.

Referring now to FIGS. 7 and 8, another embodiment of an adjustment mechanism 400 is shown in detail. The view of FIG. 7 is similar to that shown in FIG. 3 but rotated approximately ninety degrees to the right about a generally vertical axis. The view in FIG. 8 is similar to that shown in FIG. 2 but rotated about ninety degrees to the left around a vertical axis. There is illustrated a partial seat assembly including a seat pan 402 and a seat plate 404. Also illustrated is the adjustment mechanism 400 including a cup handle 408, a threaded insert 410, a first ring 412 and a second ring 414. The cup handle is constructed in the same manner as has already been described for the cup handle 339, FIG. 4. The threaded insert 410 is very similar to the threaded insert 338 described in FIG. 4, but the threaded insert 410 has a modification.

Figure 9:
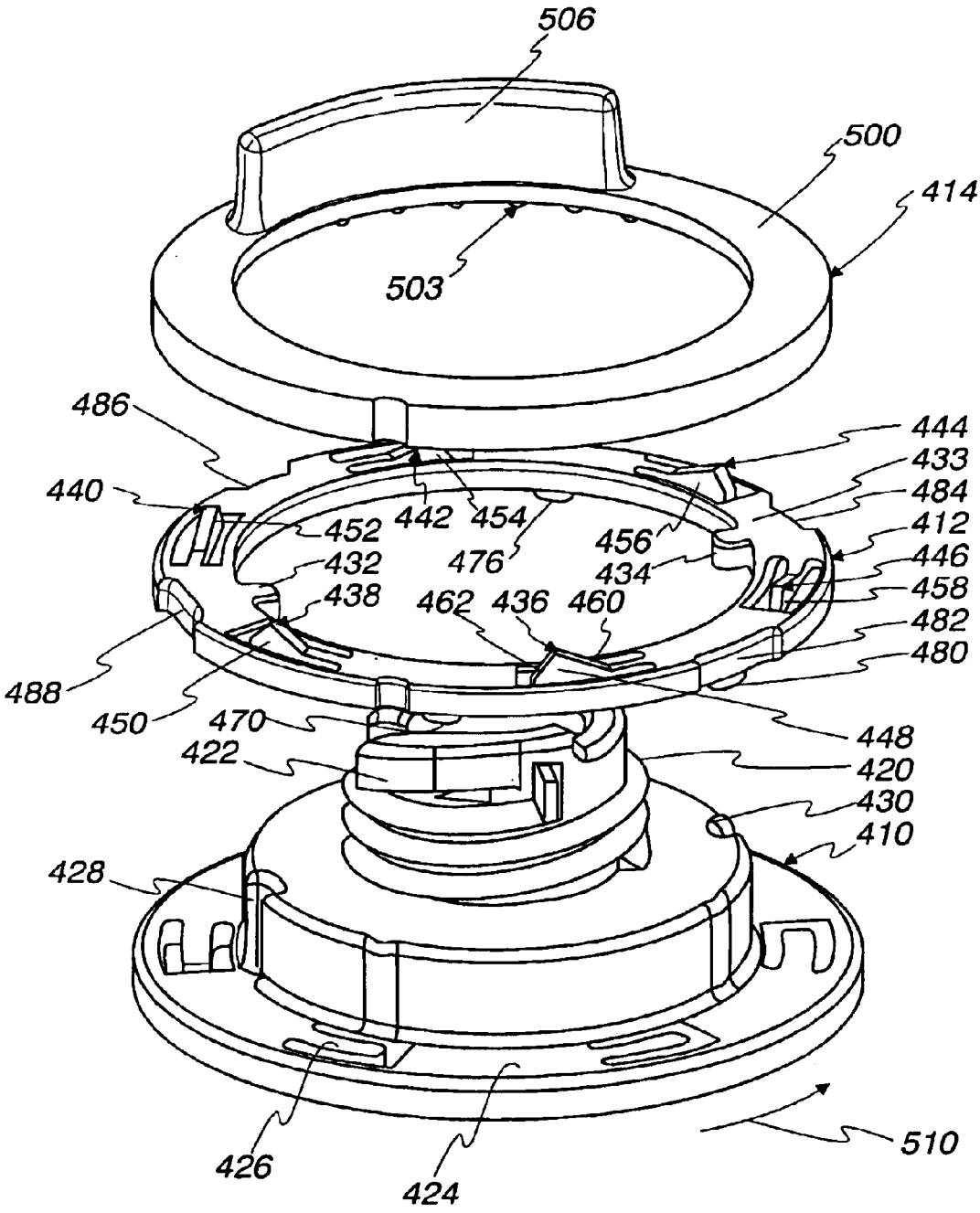
FIG. 9 is a downward looking, exploded isometric view of the threaded insert, a lower ring and an upper ring.
Figure 10:
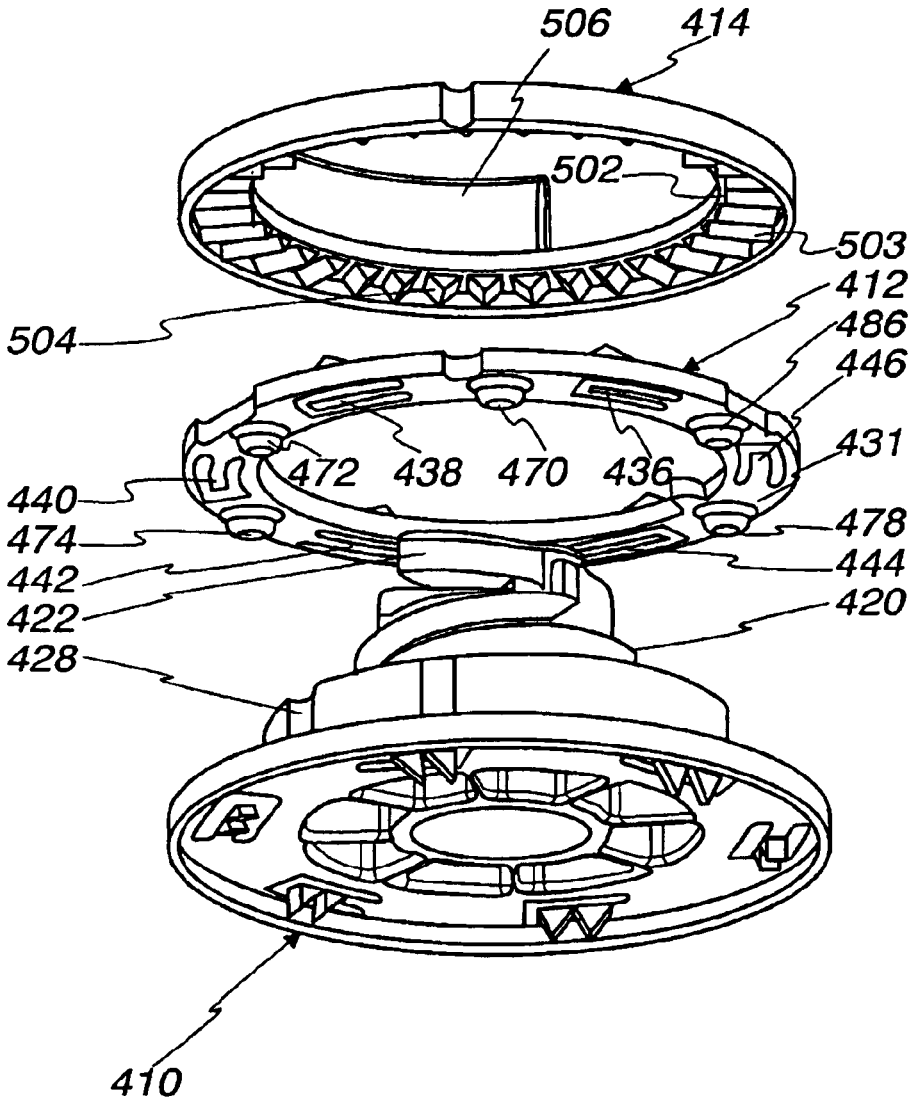
FIG. 10 is an upward looking, exploded isometric view of the threaded insert and the two rings.

Referring now to FIGS. 9 and 10, the threaded insert includes a screw thread portion 420 with an extending flexing tooth 422, an annular rim 424 and an array of resiliently mounted or cantilevered teeth assemblies, such as the assembly 426. As already explained, the cantilevered teeth assemblies allow the threaded insert to "slip" or moved relative to the cup handle which has fixed teeth so as to limit the amount of torque applied by the cup handle to the threaded insert. In addition, the threaded insert includes oppositely disposed grooves 428, 430 which act as key elements to be described below.

The anti-loosening feature of the adjustment mechanism is accomplished by the first and second rings 412, 414. The first ring 412 is a structure having a generally circular configuration including two key elements 432, 434 which are complementary to the key elements 428, 430 of the threaded insert. Each key 432, 434 is received by a respective groove 428, 430. Each ring includes a bottom surface 431 and a top surface 433. The first ring also includes an array of cantilevered or resiliently mounted teeth assemblies 436, 438, 440, 442, 444, 446 where the teeth 448, 450, 452, 454, 456, 458 are extending upwardly in a direction opposite to the teeth assemblies of the threaded insert. The cantilevered teeth each includes two slanted surfaces, such as the surfaces 460 and 462 on tooth 448 where it may be seen that the first slanted surface 460 is angled at about thirty degrees from a reference plane coincident with the top surface 433. The second slanted surface 462, however, is disposed at an angle of about sixty degrees to the reference plane. Extending from the bottom surface 431 of the first ring are an array of spacers 470, 472, 474, 476, 478, 480 which are designed to abut against the annular rim 424 when the adjustment mechanism is assembled.

The spacers provide a predetermined distance between the bottom surface of the first ring 412 and the annular rim 424 of the threaded insert 410. This allows the array of cantilevered teeth assemblies to flex downwardly toward the annular rim 424 during operation as will be explained below. The first ring 412 also includes a rim having spaced recesses 482, 484, 486, 488 for accommodating the snap retainers 344 on the cup handle.

The second ring 414 includes an upper surface 500 and a lower surface 502, a set of fixed teeth 503, such as the tooth 504, extending from the lower surface and a key element 506 extending upwardly from the top surface. The key element is an arcuate shaped projection which is received by the fastener receiving opening 332 in the seat plate 302, FIG. 2. The fastener receiving opening is a complementary key element to the key element on the second ring. Once the second ring is inserted into the fastener receiving opening 332, the second ring will no longer be free to rotate. However, the first ring 412 is keyed to the threaded insert which in turn is constructed to rotate with the cup handle when a user of the chair rotates the cup handle during adjustment of the seat.

It can now be appreciated that when the cup handle/threaded insert is rotated in a counterclockwise direction, in the direction of arrow 510, FIG. 9, to tighten the fastener, the teeth (such as the tooth 448) of the first ring 412 will engage and be cammed by the teeth 503 of the second ring 414. Because of the lesser angle of the first slanted surface 460 of the teeth, the amount of force necessary to flex or cam the cantilevered mounted teeth is relatively small. This rotation and flexing occurs when the adjustment mechanism is being tightened so as to create a frictional engagement between the seat plate and the seat pan. Once a predetermined amount of torque has been applied to the threaded insert, the cup handle will slip and provide no further rotational movement to either the threaded insert nor the keyed first ring.

The anti-loosening feature comes about when there is vibrations or the like tending to cause the cup handle, threaded insert and keyed first ring to rotate in a clockwise direction and loosen the frictional engagement between the seat plate and the seat pan. As can now be appreciated, the cantilevered teeth of the first ring engages the fixed teeth of the second ring along the second slanted surface 462 which is disposed at a larger angle from the reference plane. Hence, the force required to loosen the fastener, that is to flex or cam the teeth assemblies of the first ring when moving in a direction opposite to the arrow 510, is higher than that which was initially required to tighten the fastener. The amount of force required will be substantially larger and be a function of the ratio of the angle of the first slanted surface to the angle of the second slanted surface. This results in a restraint so that loosening of the fastener is more difficult and is generally prevented.

The specification above describes in detail preferred embodiments of the present invention. Other examples, embodiments, modifications and variations will under both the literal claim language and the doctrine of equivalents come within the scope of the invention defined by the appended claims. For example, different types of material, different sizes and shapes for the seat pan and the seat plate and different shapes for the fastener are all considered equivalent structures and will also come within the literal language of the claims. Also, the adjustment mechanism may be used to adjust a backrest in a vertical direction or other relatively moveable items. Still other alternatives will also be equivalent as will many new technologies. There is no desire or intention here to limit in any way the application of the doctrine of equivalents nor to limit or restrict the scope of the invention.

What is claimed is:

1. An adjustment mechanism for locking and unlocking two relatively movable parts, said mechanism comprising:

a fastener with a key element;

a first structure having a key element complementary to said key element of said fastener; and a second structure having a key element adapted to engage a complementary key element of one of said two relatively movable parts to prevent said second structure from moving, said first and said second structures including elements for allowing relative movement of said first and said second structures in a first direction at a first torque level and in a second direction at a higher second torque level.

2. The mechanism as claimed in claim 1 wherein:

said first structure is a first ring and said second structure is a second ring.

3. The mechanism as claimed in claim 2 wherein:

said second ring includes an array of fixed teeth; and said first ring includes at least one resiliently mounted, slanted tooth assembly.

4. The mechanism as claimed in claim 3 wherein:

said tooth assembly of said first ring has two slanted surfaces for engaging said teeth of said second ring, a first slanted surface disposed at a smaller angle from a reference plane and a second slanted surface disposed at a larger angle from said reference plane wherein a force needed to move said tooth of said first ring is greater on said second slanted surface than on said first slanted surface.

5. The mechanism as claimed in claim 4 wherein:

said first ring includes a spacer for locating said first ring at a predetermined distance from said fastener.

6. The mechanism as claimed in claim 1 including:

a torque limiting structure connected to said fastener.

7. The mechanism as claimed in claim 6 wherein:

said torque limiting structure includes a cup handle and a threaded insert, said cup handle and said threaded insert structured to allow relative movement therebetween upon the application of a predetermined level of torque.

8. The mechanism as claimed in claim 7 wherein:

said threaded insert includes cantilevered teeth and said cup handle includes mating fixed teeth.

9. The mechanism as claimed in claim 6 wherein:

said first structure is a first ring and said second structure is a second ring.

10. The mechanism as claimed in claim 9 wherein:

said second ring includes an array of fixed teeth; and said first ring includes at least one resiliently mounted, slanted tooth assembly.

11. The mechanism as claimed in claim 10 wherein:

said tooth assembly of said first ring has two slanted surfaces for engaging said teeth of said second ring, a first slanted surface disposed at a smaller angle from a reference plane and a second slanted surface disposed at a larger angle from said reference plane wherein a force needed to move said tooth assembly of said first ring is greater on said second slanted surface than on said first slanted surface.

12. An adjustment mechanism for locking and unlocking a chair seat pan from a chair seat plate, said mechanism being torque limited and comprising:

a fastener with a key element;

a first ring having a key element complementary to said key element of said fastener; and a second ring having a key element adapted to engage a complementary key element of said seat plate to prevent said second ring from rotating, said first and said second rings including elements for allowing relative rotation of said first and said second rings in a first direction at a first torque level and in an opposite direction at a higher second torque level.

13. The mechanism as claimed in claim 12 including:

spacers on said first ring.

14. The mechanism as claimed in claim 12 wherein:

said second ring includes an array of fixed teeth and said first ring includes at least one resiliently mounted, slanted tooth assembly.

15. The mechanism as claimed in claim 14 including:

a torque limiting structure connected to said fastener.

16. The mechanism as claimed in claim 15 wherein:

said torque limiting structure includes a cup handle and a threaded insert, said cup handle and said threaded insert structured to allow relative movement therebetween upon the application of a predetermined level of torque.

17. The mechanism as claimed in claim 15 wherein:

said threaded insert includes cantilevered teeth and said cup handle includes mating fixed teeth.

18. The mechanism as claimed in claim 17 wherein:

said first ring includes cantilevered teeth.

* * * * *